US005460321A

United States Patent [19]

Focke

[11] Patent Number: 5,460,321

[45] Date of Patent: Oct. 24, 1995

[54] BLANK FOR FORMING A CUBOID WRAPPING FOR GROUPS OF CIGARETTE PACKS

[75] Inventor: Heinz Focke, Verden, Germany

[73] Assignee: Focke & Co. (GmbH & Co.), Verden, Germany

[21] Appl. No.: 288,892

[22] Filed: Aug. 10, 1994

Related U.S. Application Data

[63] Continuation of Ser. No. 93,992, Jul. 21, 1993, abandoned, which is a continuation of Ser. No. 907,296, Jul. 1, 1992, abandoned.

[30] Foreign Application Priority Data

Jul. 30, 1991 [DE] Germany ..... 41 25 119.9

[51] Int. Cl.[6] ..... B65D 5/08; B65D 75/08; B65D 85/10

[52] U.S. Cl. ..... 229/87.13; 206/273; 229/933

[58] Field of Search ..... 229/DIG. 9, 87.13, 229/87.18, 190, 933; 206/273

[56] References Cited

U.S. PATENT DOCUMENTS

| | | | |
|---|---|---|---|
| 1,929,459 | 10/1933 | Wellman | 229/DIG. 9 |
| 2,850,207 | 5/1956 | Toensmeier . | |
| 3,003,674 | 10/1961 | Ringler | 229/DIG. 9 |
| 3,536,246 | 10/1970 | Rosen . | |
| 3,752,308 | 8/1973 | Begemann | 206/273 |
| 4,738,359 | 4/1988 | Phillips, Jr. . | |
| 4,903,844 | 2/1990 | Oglesby . | |

FOREIGN PATENT DOCUMENTS

| | | | |
|---|---|---|---|
| 390545 | 10/1990 | European Pat. Off. . | |
| 1916178 | 1/1965 | Germany . | |
| 6943235 | 11/1969 | Germany . | |
| 2757251 | 7/1979 | Germany . | |
| 3021937 | 12/1980 | Germany . | |
| 835451 | 5/1960 | United Kingdom . | |
| 0937385 | 9/1963 | United Kingdom | 229/937 |
| 1568523 | 5/1980 | United Kingdom . | |

*Primary Examiner*—Stephen P. Garbe

*Attorney, Agent, or Firm*—Sughrue, Mion, Zinn, Macpeak & Seas

[57] ABSTRACT

A blank for forming a cuboid wrapping for groups of cigarette packs (bundles) comprises a front wall, a rear wall, longitudinal walls and a longitudinal flap which is located on a free longitudinal side of a front, rear or longitudinal wall in order to form an overlap, and comprising end flaps which are located at the front wall and rear wall in order to form end walls. The blank is designed in such a way that waste is kept to a minimum when several individual blanks are arranged within a larger sheet. For this purpose, the front wall (12) has a larger end flap on one side (23) and a smaller end flap (19) on the opposed side (22), and the rear wall (13) has a smaller end flap on the side where the larger end flap (18) adjoins the front wall and it has a larger end flap (20) on the other side.

5 Claims, 3 Drawing Sheets

BLANK FOR FORMING A CUBOID WRAPPING FOR GROUPS OF CIGARETTE PACKS

This is a continuation of application No. 08/093,992, filed Jul. 21, 1993, now abandoned, which is a continuation of application No. 07/907,296, filed Jul. 1, 1992, now abandoned.

BACKGROUND OF THE INVENTION

The invention relates to a blank for forming a cuboid wrapping for groups of cigarette packs (bundles), comprising a front wall, a rear wall, longitudinal walls and a longitudinal flap which is located on a free longitudinal side of the front wall or rear wall in order to form an overlap with the longitudinal wall which is free in the folded and closed wrapping, and comprising end flaps which are located on end sides of the front wall, the rear wall and a longitudinal wall in order to form end walls, in which blank each of the two end sides is associated with an outer end flap (cover flap) which extends over the entire face of an end wall, and in which the other end flaps have a significantly smaller width in the longitudinal direction of the blank.

Such blanks are cut from a larger sheet of paper, paperboard or cardboard. It is important to keep the waste which is produced as a result of the interspaces between the individual blanks to a minimum. Another important aspect is the fact that the bundle which is made with the aid of the blank is a mass product and buyers are use to a certain shape and way of handling. If possible, neither shape nor handling properties should be affected by a modification of the blank.

SUMMARY OF THE INVENTION

The invention is based on the object to reduce the expenditure of material for the production of blanks of the above mentioned type, without altering the outer appearance of a package which is formed from such a blank.

To attain this object, the blank according to the invention is characterized in that the outer end flaps are arranged diametrically opposite one another, in particular such that on the one side they are attached to the rear wall and on the opposite side to the front wall of the blank.

The design of the blank according to the invention makes it possible to arrange the blanks within a sheet of the packaging material or within a web of material in a tooth-type interlocked manner. The reciprocal interlocked engagement of the blanks reduces the waste of material when the blanks are produced by way of punching. Consequently, more blanks can be formed from a sheet of a certain size. Nevertheless, the outer appearance of a package which is formed from such a blank corresponds to that of conventional packages.

According to the invention, the other end flaps of the blank are arranged and designed to correspond to the relative position of the outer end flaps which act as cover flaps.

BRIEF DESCRIPTION OF THE DRAWINGS

An exemplary embodiment of the invention will be described below in detail with reference to the drawings, in which.

DESCRIPTION OF A PREFERRED EMBODIMENT

Figure 1:
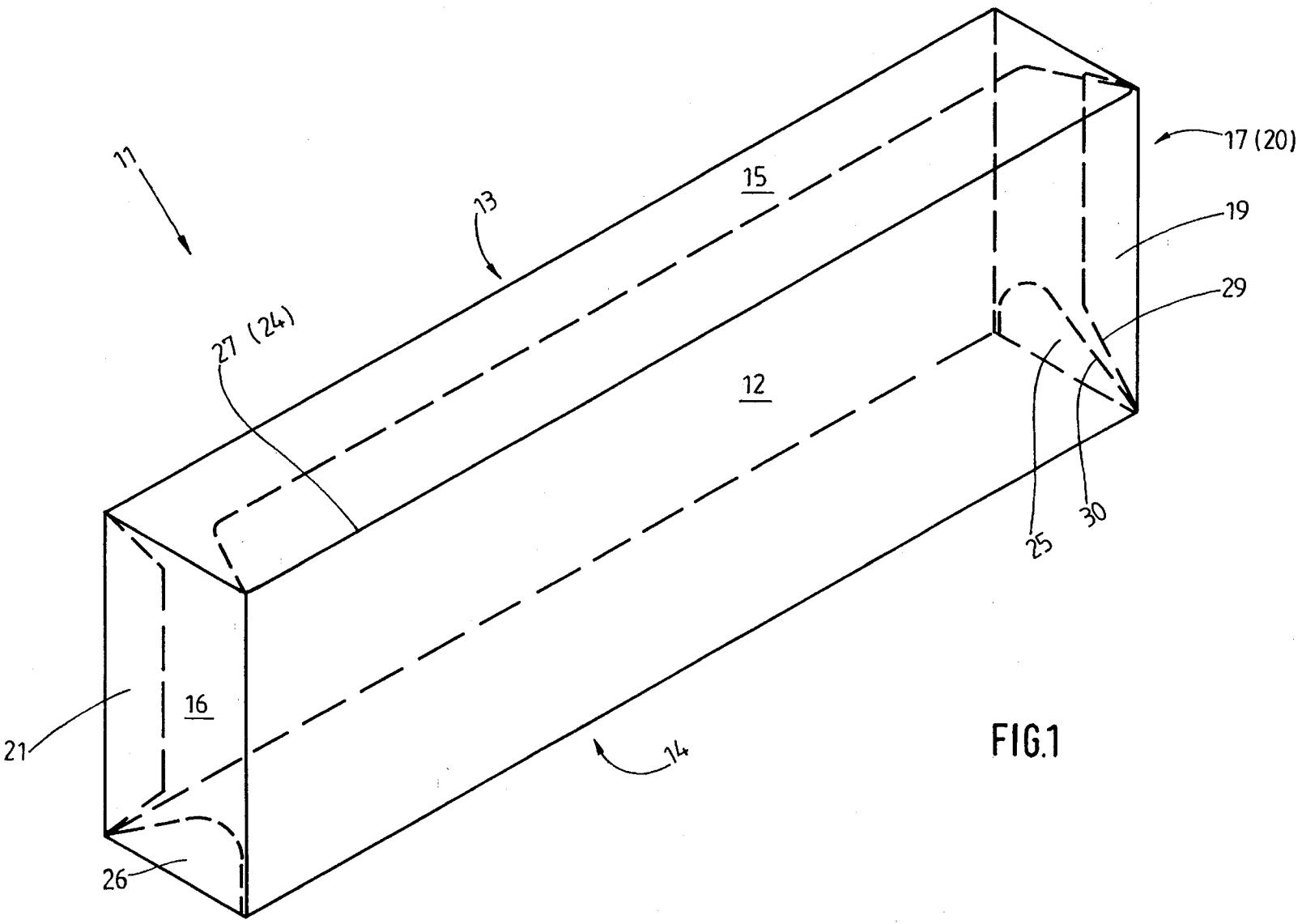
FIG. 1 is a perspective view of a wrapping formed from a blank according to the invention.

FIG. 1 illustrates a wrapping which is folded from a blank 10 according to the invention. The cuboid wrapping for groups of cigarette packs comprises a front wall 12 and a rear wall 13 with large surface areas which are linked to one another by narrow longitudinal walls, in particular a lower longitudinal wall 14 and an upper longitudinal wall 15. The ends of the wrapping 11 are delimited by end walls 16, 17.

To form the end walls 16, 17, the blank 10 comprises various flaps which are located at various blank panels defining the walls 12, 13, 14, 15 and will be described in detail in the following. Front wall 12 and rear wall 13 both have a large and a small end flap. The end flaps which belong to the front wall 12 are designated with numerals 18 (large) and 19 (small), whereas, analogously, the end flaps which adjoin the rear wall 13 are designated 20 (large) and 21 (small). The end walls 16, 17 are mostly formed from the large end flaps 18, 20, whereas the small end flaps 19, 21 essentially act as connecting strips with the opposed front or rear wall 12, 13. The end flaps 18 to 21 are arranged in such a way that on one side 22 of the blank, there is a small and a large end flap. The same applies to the other side 23 of the blank 10. In accordance with the condition that one large and one small end flap are located at each wall 12 and 13, the large end flap 18 and the small end flap 21 on side 23 are interchanged compared to side 22.

Figure 2:
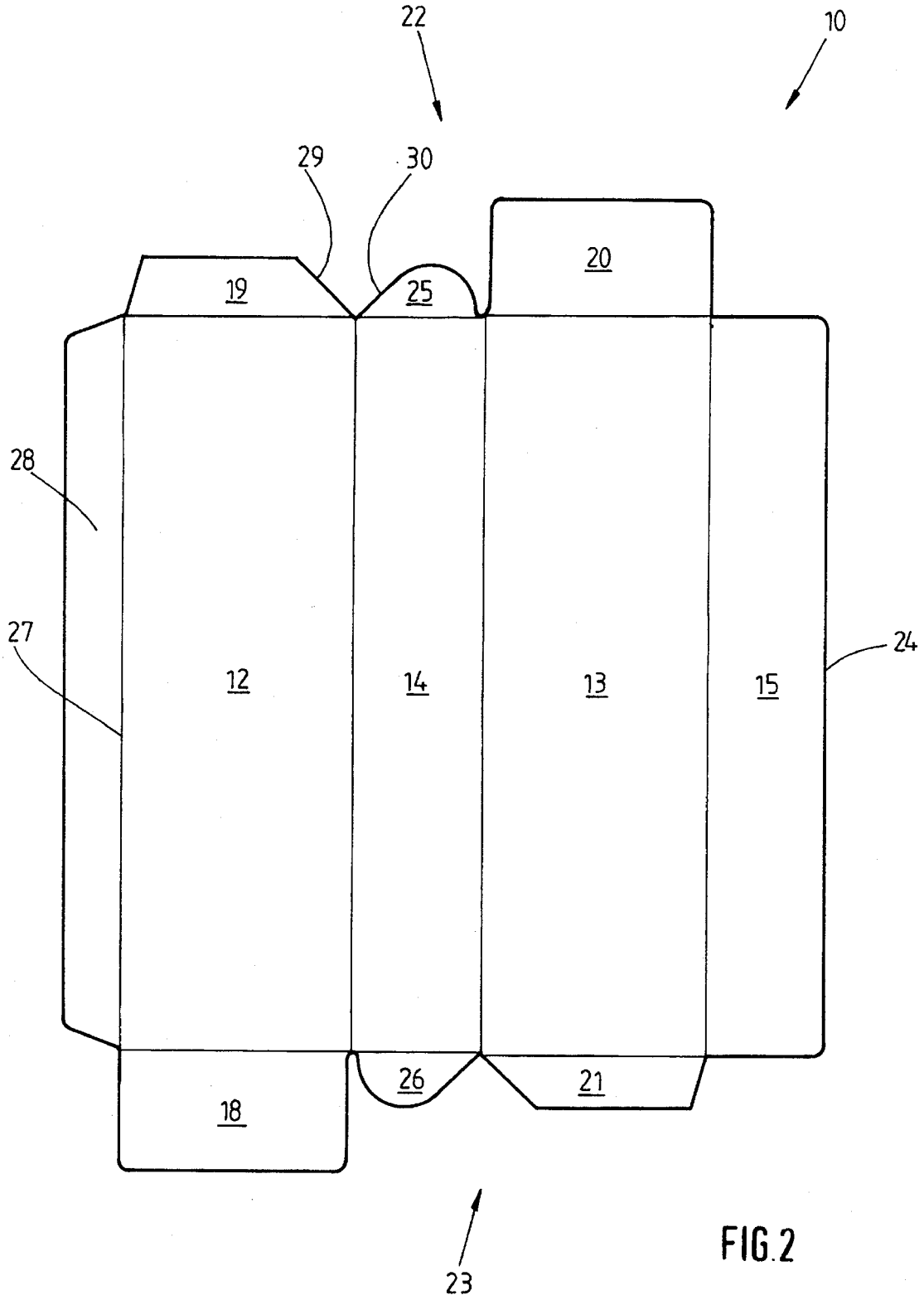
FIG. 2 is a top plan view of the blank according to the invention.

One of the longitudinal walls does not have any end flaps, which, according to FIG. 2, is the outer longitudinal wall 15 which has a free side 24. The other longitudinal wall 14, which, according to FIG. 2, is located between front wall 12 and rear wall 13, has one end flap 25, 26 on each side.

One of the walls 12 to 15, which according to FIG. 2, is the front wall 12, is provided with a longitudinal flap 28 on an outer longitudinal side 27. In the completed wrapping, this longitudinal flap 28 serves as a connection with the upper longitudinal wall 15 which is located adjacent to the longitudinal side 27 after folding. Thus, the free side 24 and the longitudinal side 27 come to rest directly next to one another in the completed wrapping.

The small end flaps 19, 21 and the end flaps 25, 26 have a special design. According to FIG. 2, the small end flap 19 and the end flap 25 of the lower longitudinal wall 14 are located adjacent to one another. Both are designed asymmetrically, each with a main portion of their surface directed, away from the adjacent end flap. The main portion of the surface of the end flap 25 is directed towards the large end flap 20. In the spread-out blank 10 according to FIG. 2, the adjacent end flap edges 29 (small end flap 19) and 30 (end flap 25) extend at an angle to one another which is greater than 90°. As a result, there is a maximum of two superposed layers of blank portions in the ready-folded wrapping in the region of the end wall 17. These superposed portions are the large end flap 20 which forms a first plane and the end flaps 19, 25 which form a second plane.

The end flap 25 at the longitudinal wall 14 has a semicircular or elliptic design, whereas the small end flap 19 at the front wall 12 has an approximately trapezoidal design. Accordingly, both end flaps taper towards the outside.

The relative arrangement of the end flaps 19, 25 as described above and the shape of these flaps reappear on the opposed side 23 in the form of the end flaps 21, 26.

According to FIG. 2, the end flaps of one side 22 are designed point-symmetrically relative to the end flaps of the other side 23.

Each of the large end flaps 18, 20 extends over the entire face of the end wall 16 and 17, respectively, which is why they are also called cover flaps.

Figure 3:
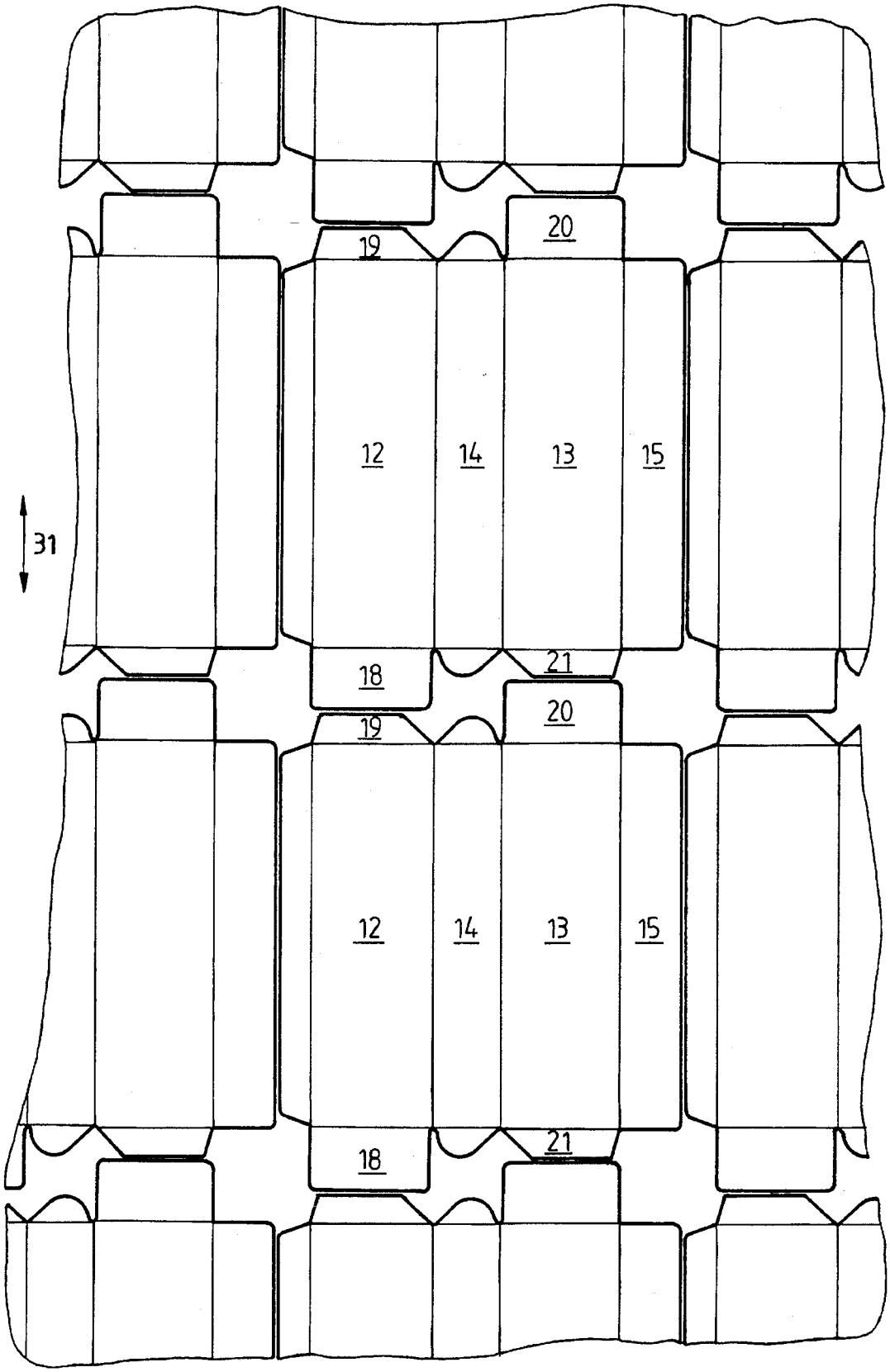
FIG. 3 shows a waste-saving arrangement of several blanks within one sheet.

FIG. 3 illustrates the arrangement of several blanks 10 within one sheet. The distance between individual blanks 10 in the longitudinal direction, i.e. in the direction indicated by arrow 31, is small as a result of the arrangement of the end flaps according to the invention. Consequently, the waste surfaces which are produced are kept to a minimum. In each case, one large end flap 18 or 20 is located opposite a small end flap 19 or 21. The blanks 10 are located relative to one another in such a way that they are neither offset in the longitudinal direction nor in the transverse direction. As a result, and as shown in FIG. 3, there is formed in the web only one waste surface in each web area bounded by four adjoining blanks.

Any overlaps in the folded wrapping which is filled with cigarette groups are adhesively bonded to one another, with the possible exception of the overlap of the longitudinal flap 28 and the upper longitudinal wall 15.

Transitions between the walls and/or flaps may be perforated, pre-punched or embossed in order to facilitate the folding of the blank.

Apart from the above described blank, the invention also relates to a package which is formed from such a blank and which preferably contains groups of smaller cigarette packs.

I claim:

1. A web of material containing a plurality of blanks (10) for cuboid wrappers each for entirely enwrapping groups of cigarette packs, said web having a longitudinal dimension and a transverse, lateral dimension, wherein:

a) each blank (10) has a rectangular front wall first panel (12) having its two longer sides extending in the longitudinal direction (31), and having two short sides;

b) a rectangular narrow longitudinal wall second panel (14), a rectangular wider rear wall third panel (13) and a narrower rectangular longitudinal wall fourth panel (15) successively adjoin one of the longer sides of the rectangular front wall first panel (12) in a direction transverse to the longitudinal direction (31);

c) a narrow longitudinal flap fifth panel (28) adjoins the other longer side of the rectangular front wall first panel (12) in the direction transverse to the longitudinal direction (31), and forms, with said longitudinal wall fourth panel (15), closing tabs for an opening of said each wrapper;

d) all of said first, second, third, fourth and fifth panels (12, 13, 14, 15, 28) respectively extend parallel to one another in the longitudinal direction;

e) for forming end walls of said each cuboid wrapper, said first, second and third wall panels (12, 13, 14) are provided with respective end flaps (18, 19, 20, 21, 25, 26) adjoining the short sides of said first, second and third rectangular wall panels (12, 13, 14);

f) a first larger end flap (18) adjoins one short side of the from wall first panel (12) and a second larger end flap (20), of the same size as said first larger end flap, adjoins the longitudinally opposite short side of the rectangular rear wall third panel (13);

g) a first smaller end flap (19) adjoins the other short side of the from wall rectangular first panel (12), and a second smaller end flap (21), of the same size as said first smaller end flap, adjoins the other short side of the rectangular rear wall third panel (13), h) a first asymmetrical end flap (25), located between said first smaller end flap (19) and said second larger end flap (20), adjoins one of the short sides of the rectangular narrow longitudinal wall second panel (14); and a second asymmetrical end flap (26), located between said first larger end flap (18) and said second smaller end flap (21), adjoins the other, opposite short side of said rectangular narrow longitudinal wall second panel (14);

i) the shape and the location of the first asymmetrical end flap (25), relative to said first smaller end flap (19) and said second larger end flap (20), correspond to those of said second asymmetrical end flap (26) relative to said first larger end flap (18) and said second smaller end flap (21), so that said first and second asymmetrical end flaps (25, 26) are located laterally inverted relative to one another; and j) the blanks (10) are arranged in said web with substantially no transverse or longitudinal offset relative to one another, so that the first and second larger end flaps (18, 20) of each blank respectively abut the first and second smaller end flaps (19, 21) of longitudinally adjacent blanks and vice versa, so that the narrow longitudinal flap fifth panel (28) of each blank abuts the narrower longitudinal wall fourth panel (15) of a laterally adjacent blank in said web, and so that there is formed in the web only one waste surface in each web area bounded by four adjoining ones of said blanks (10).

2. The web of material according to claim 1, wherein each of the first and second asymmetrical end flaps (25, 26) has a free end flap edge formed by a curved portion and a straight line (30), and wherein the straight line (30) is inclined relative to said short sides of said first, second and third wall panels (12, 13, 14).

3. The web of material according to claim 2, wherein the narrow longitudinal flap fifth panel (28) is laterally narrower than said longitudinal wall fourth panel (15) and wherein the longitudinal flap fifth panel (28) has short side edges which form an extension of folding lines between the first and third wall panels (12, 13) on one hand, and the first and second larger end flaps (18, 20) and the first and second smaller end flaps (19, 21) on the other hand, and which are inclined relative to corresponding short side edges of the rectangular longitudinal wall fourth panel (15), so that the longitudinal flap fifth panel (28) adjoins the from wall first panel (12), converging laterally outwardly of the blank, and has a shape of a trapezoid.

4. The web of material according to claim 1, wherein the narrow longitudinal flap fifth panel (28) is laterally narrower than said longitudinal wall fourth panel (15) and wherein the longitudinal flap fifth panel (28) has short side edges which form an extension of folding lines between the first and third wall panels (12, 13) on one hand, and the first and second larger end flaps (18, 20) and the first and second smaller end flaps (19, 21) on the other hand, and which are inclined relative to corresponding short side edges of the rectangular longitudinal wall fourth panel (15), so that the longitudinal flap fifth panel (28) adjoins the from wall first panel (12), converging laterally outwardly of the blank, and has a shape of a trapezoid.

5. A web of material according to claim 1, wherein said each web area is between the first and second asymmetrical end flaps (25, 26) in longitudinally adjacent blanks.

* * * * *